United States Patent [19]

Fredrickson

[11] 4,077,385

[45] Mar. 7, 1978

[54] COMPOUND BOW STRINGING DEVICE AND COMPOUND BOW INCLUDING THE SAME

[76] Inventor: Bert E. Fredrickson, 305 E. Walnut St., Green Bay, Wis. 54301

[21] Appl. No.: 708,861

[22] Filed: Jul. 26, 1976

[51] Int. Cl.[2] ..... F41B 5/00

[52] U.S. Cl. ..... 124/24 R; 29/235; 124/90

[58] Field of Search ..... 124/90, 24 R, 23 R, 124/80, 1, 86, 88; 29/235

[56] References Cited

U.S. PATENT DOCUMENTS

| | | | |
|---|---|---|---|
| 3,000,628 | 9/1961 | Kellogg | 124/23 R X |
| 3,055,655 | 9/1962 | Chelf | 124/23 R X |
| 3,207,145 | 9/1965 | Browning et al. | 124/23 R |
| 3,253,587 | 5/1966 | Pearson | 124/23 R |
| 3,281,928 | 11/1966 | Dolch | 124/23 R |
| 3,294,078 | 12/1966 | Allen | 124/23 R |
| 3,854,467 | 12/1974 | Hofmeister | 124/90 X |
| 3,967,609 | 7/1976 | Frydenlund | 124/90 X |
| 3,987,777 | 10/1976 | Darlington | 124/86 |

OTHER PUBLICATIONS

"Compound Bow String Changer" - Archery Magazine, 1974, p. 47, See Part A and FIG. A.

*Primary Examiner*—Harland S. Skogquist
*Assistant Examiner*—William R. Browne
*Attorney, Agent, or Firm*—McGarry & Waters

[57] ABSTRACT

A bow stringing and unstringing device for a compound bow has a stop mounted on the outer ends of resilient limbs of a compound bow to prevent movement of the outer ends of the anchor wires of the bow back over the pulleys when the bowstring is removed from the ends of the anchor wires. A stringer wire has a suitable hook for attaching the ends thereof to suitable connector, for example, an eye-bolt, also at the ends of the resilient limbs of the bow for releasing the tension on the bowstring when pulled like the bowstring so that the bowstring may be removed from the bow. A novel brace which fits between the drawn stringer wire and the bow handle is provided for maintaining the tension in the stringer wire while removing and replacing the bowstring and for carrying the stringer wire when the same is not in use.

23 Claims, 7 Drawing Figures

COMPOUND BOW STRINGING DEVICE AND COMPOUND BOW INCLUDING THE SAME

BACKGROUND OF THE INVENTION

1. Field of the Invention

This invention relates to compound shooting bows. In one of its aspects, the invention relates to a compound shooting bow having a means for stringing and unstringing a bowstring while maintaining the tension in the bow subsequent to removal of the bowspring. In another of its aspects, the invention relates to a device for stringing and unstringing a compound shooting bow while maintaining the tension in the bow subsequent to removal of the bowstring.

2. State of the Prior Art

Compound bows are hunting bows in which an anchor wire is wound around two or more pulleys and secured to the end of the bowstring. The pulleys and the anchor-wire system give significantly greater mechanical advantage and accordingly greater power to a bow than the conventional bow in which the bowstring is secured directly to the outer end of the limbs of the bow.

The mechanical advantage of these bows turns into a disadvantage when it comes to stringing and unstringing the bows. Because of the significant mechanical advantage, it is extremely difficult to string and unstring the bow without special equipment. Ordinarily, while hunting, there is little or no need to remove and replace the bowstring.

However, practically all state hunting regulations require that a bow used for hunting wild game must be unstrung or carried in a case while being transported in a motor vehicle or while being carried in a hunting area before and after legal shooting hours. Although cases for these bows are available, they are cumbersome and bulky. Consequently, the cases are undesirable to carry and use. Because of the extreme difficulty of stringing and unstringing a bow, the compound bow must almost always be carried in the case.

SUMMARY OF THE INVENTION

The invention comprises a compound shooting bow with a means for stringing and unstringing the bow while maintaining tension within the bow. The bow has a handle portion with a pair of resilient limbs extending outwardly thereof, a pulley mounted at the outer end of each resilient limb, a bowstring and anchor-wire means including a pair of outer ends, one of which is wound around each pulley to tension the resilient limbs. Typically, the bowstring is removably secured through a hook or other suitable means to the outer ends of the anchor wire.

According to the invention, means are provided on the outer ends of the resilient limbs and on the anchor wire means to prevent movement of the outer ends of the anchor wire means back around the pulleys and to thereby maintain tension on the anchor wire means. In this manner, the bowstring can be easily removed without a loss of bow tension from the anchor cable means. Desirably, means are provided for mounting a stringer wire on the outer ends of the resilient limbs so that the tension on the bowstring can be released for ease of removal thereof by securing the stringer wire to the outer ends of the resilient limbs and tensioning the stringer wire. The stringer wire useful in accordance with the invention has a length approximately equal to the distance between the stringer wire mounting means on the resilient limbs.

The invention further comprises a brace sized to fit between the handle portion of the bow and a central portion of the stringer wire when the stringer wire has been pulled away from the handle portion to relieve the tension on the bowstring. The brace includes a seating means for retaining the brace on the handle portion at one end portion of the brace and means for retaining the stringer wire on another end portion of the brace. Further, the brace includes means for releasably retaining the stringer wire when the same is not in use. This stringer wire retaining means includes a lip on one end on the brace and at least one hole in an opposite end portion of the brace whereby the stringer wire may be looped around the lip and drawn through the hole. The stringer wire desirably contains a loop at at least one end thereof for carrying the stringer wire and the brace from a belt or hook.

The movement preventing means for the anchor wire means desirably includes a guard means secured to each end of the resilient limbs of the bow adjacent the ends of the anchor wire. Stop means are retainably mounted at the end portions of the anchor wire means such that the stop means abuts the guard means and grips the end portions of the anchor wire means the bowstring is removed from the ends of the anchor wire.

In accordance with one embodiment of the invention, the guard comprises a curved bifurcated clip of stiff lightweight material such as magnesium alloy or aluminum. An upper part of each clip is secured to one end of the resilient limbs and a lower bifurcated end of the clips forms a slot through which one of the ends of the anchor wire means passes. Thus, the bifurcated end of a curved clip is positioned between one of the pulleys and the stop means on each end of the anchor means.

In a specific embodiment of the invention, a stringer wire mounting means includes an eyelet-bolt mounted to each outer end of the resilient limb. Desirably, the mounted end of the eyelet-bolt secures at least in part the upper part of the curved clip to the respective end of the resilient limb.

BRIEF DESCRIPTION OF THE DRAWINGS

The invention will now be described with reference to the accompanying drawings in which.

Figure 7:
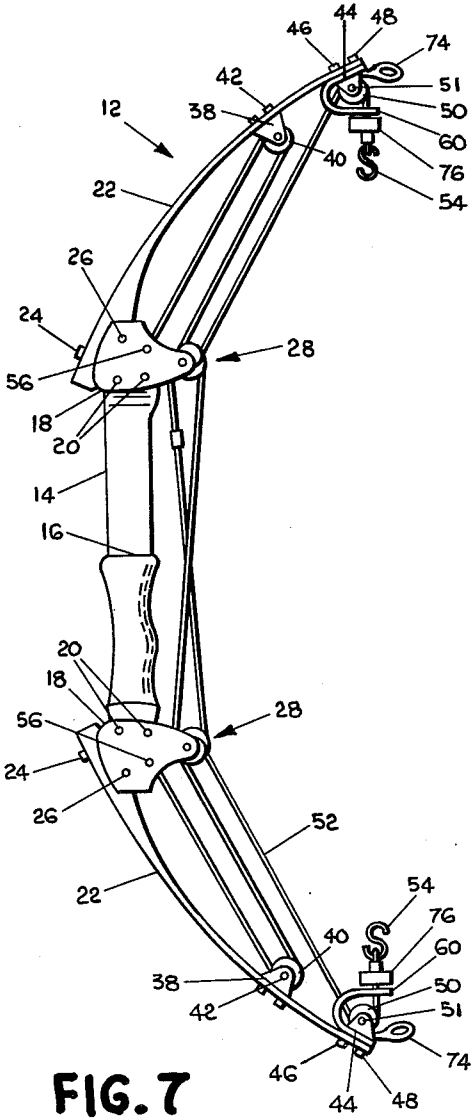
Figure 6:
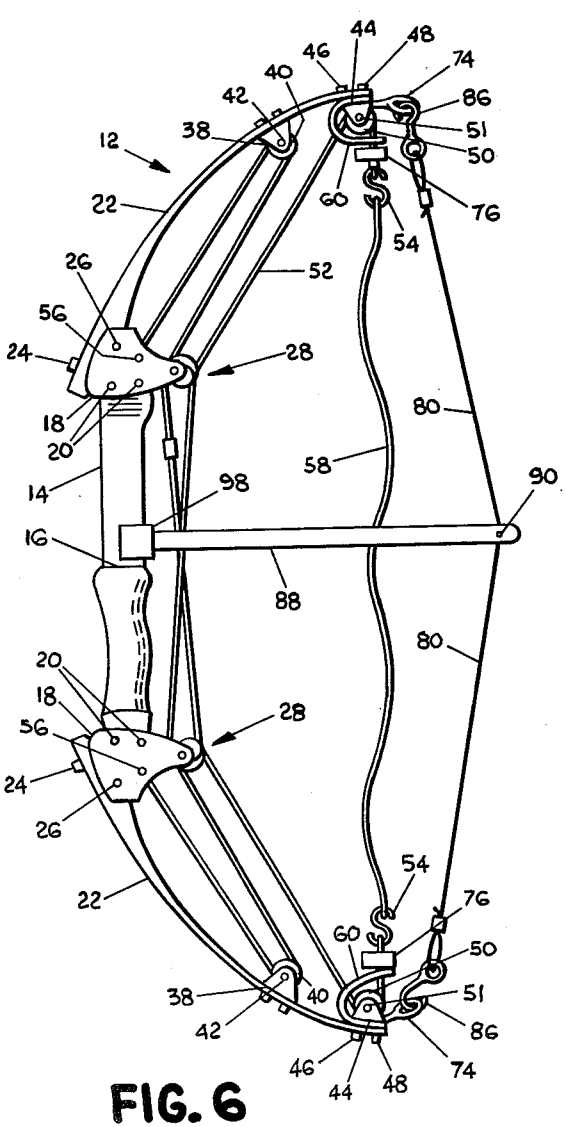
Figure 5:
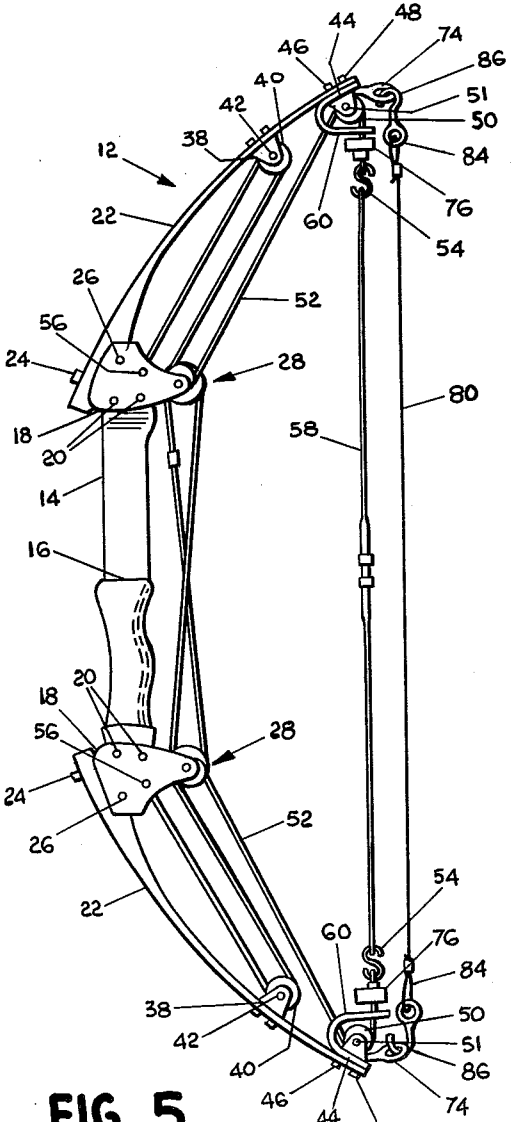
FIG. 5 is a view similar to FIG. 1 showing a bow-stringer wire attached to the bow.

Section 6 is a view similar to FIG. 5 illustrating the operation of the bow-stringer device according to the invention;

FIG. 7 is a view like FIG. 6 showing the bowstring removed from the bow.

DESCRIPTION OF THE PREFERRED EMBODIMENT

Figure 1:
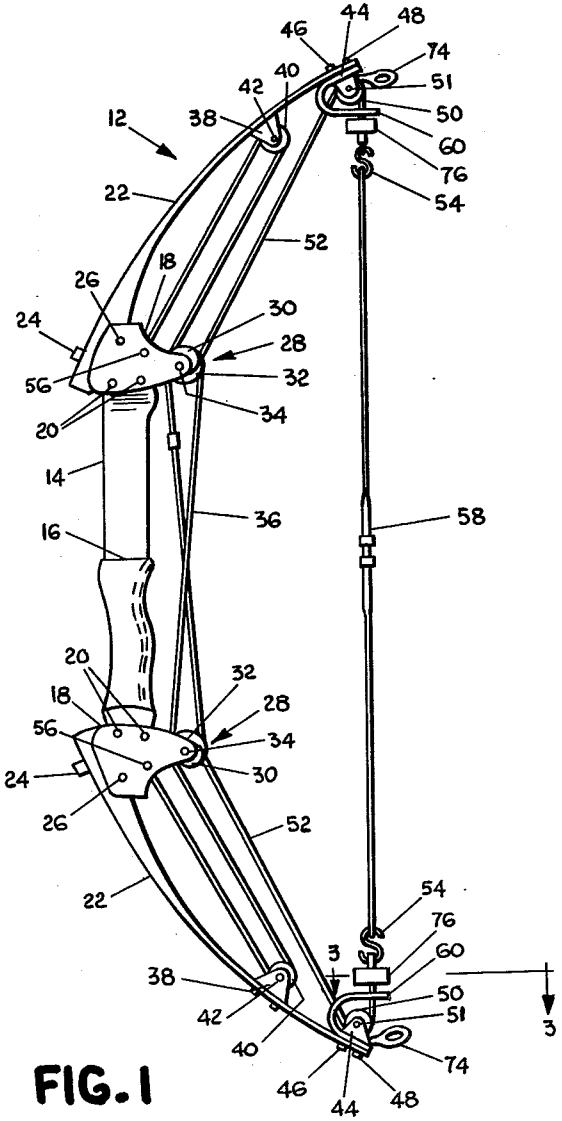
FIG. 1 is a side view of a compound bow which embodies elements of a bow-stringer device according to the invention.

Referring now to the drawings, and to FIG. 1 in particular, there is shown a compound bow 12 having a handle member 14 with a conventional arrow shelf 16.

Side plates 18 are secured to the handle member 14 at each end thereof through screws 20. A pair of flexible, resilient limbs 22 are secured to the side plates 18 in conventional fashion through pivots 26 and limb adjustment members 24.

A compound sheath structure 28 having an eccentric pulley 30 and a concentric pulley 32 is mounted between each paid of side plates 18 through axle 34. An endless connecting cable 36 is trained around the concentric pulleys 32 in each of the compound sheath structures 28. A pulley bracket 38 is secured through suitable bolts near the outer ends of each of the flexible, resilient limbs 22. A pulley 40 is mounted on each of the pulley brackets 38 through an axle 42. A second pulley bracket 44 is secured to the outer end of each of the flexible, resilient limbs 22 through bolts 46 and 48. A pulley 50 is mounted rotationally on the pulley bracket 44 through axle 51. Anchor cables 52 are secured at one end to anchor pins 56 and are wound around the pulleys 40, 32 and 50. The other end of each anchor cable has a hook 54. A bowstring 58 is strung in conventional fashion between the anchor cables 52. To this end, the bowstring 58 is provided with loops which engage the hooks 54.

The foregoing has been a general description of a known compound bow with which my invention may be used. A more complete description of this particular type of compound bow is found in Hofmeister U.S. Pat. No. 3,854,467, issued Dec. 14, 1974. Other types of compound bows to which the invention is equally applicable are illustrated in the U.S. Pat. to Allen, Nos. 3,486,495 (issued Dec. 30, 1969), Jones, 3,945,368 (issued Mar. 23, 1976), and Trotter, U.S. Pat. 3,923,035 (issued Dec. 2, 1975). It is to be understood that the invention is not limited to any particular type of compound bow and is applicable to nearly every type of compound bow.

Figure 2:
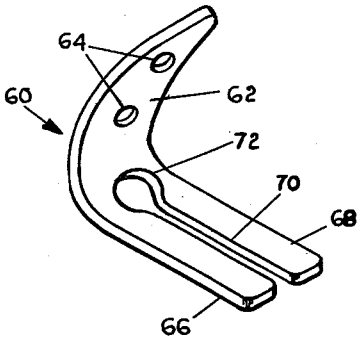
FIG. 2 is a perspective view of a shield utilized in the bow-stringer device according to the invention.

According to the invention, a guard member 60 is secured to upper and lower parts of the flexible limbs 22. As seen in FIG. 2, the guard member comprises an upper body 62 having bolt holes 64 and a pair of outwardly projecting legs 66 and 68 forming a slot 70 and a central opening 72 therebetween. As seen in FIG. 1, the guard members 60 are curved or almost U-shaped from a side perspective. The ends of the anchor cables 52 pass through the central opening 72 at one side of the pulleys 50 and pass through the slot 70 at the other side of the pulley 50. In certain instances, the pulley itself can be mounted so that a portion of it extends down into the central slot 72.

Figure 3:
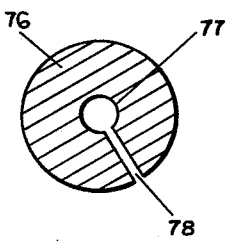
FIG. 3 is a sectional view of a stop element according to the invention.

Further according to the invention, the bolts 48 have enlarged eyelet heads 74. Stop elements 76 are mounted on the ends of the anchor cables 52 beneath the legs 66 and 68 of the guard member 60. The stop elements 76 are desirably made of a durable hard substance, for example metal or plastic, and are securely mounted on the ends of the anchor cables 52 so that the stop elements 76 cannot be pulled from the end of the cables over the hooks 54. To this end, the stop element 76 has a hole therethrough large enough to pass the anchor cable 52 but smaller than a clip on the ends of the anchor wire. If desirable, metal washers can be used between the ends of the anchor wires 52 and the stop elements 76. An example of a suitable stop element is illustrated in FIG. 3. A central hole 77 and a narrow slot 28 are provided in the stop 76. The hole 77 is slightly larger than the anchor cable 52 but smaller than the eyelet on the end of the anchor cable 52. The slot is only large enough to permit the string to be squeezed through. An alternate form of the stop can be a spherical shape having a slot and hole in much the same fashion as the cylindrical stop in FIG. 3.

Figure 4:
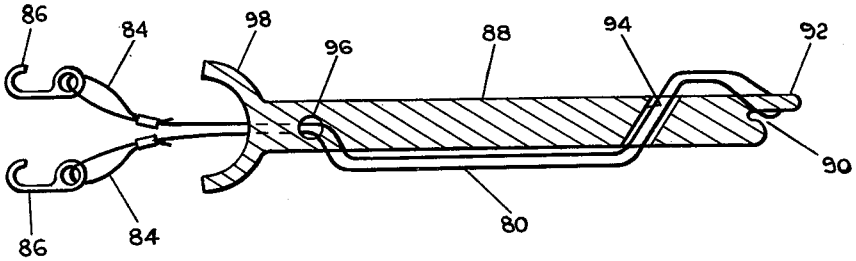
FIG. 4 is a view in section of a brace and stringer wire according to the invention.

Reference is now made to FIG. 4 for a description of the brace and stringer wires used in accordance with the invention. A flexible stringer wire 82 has a loop 84 and a hook 86 at each end thereof. The stringer wire 82 is of a length approximately equal to the distance between the eyelet heads 74 when the bow is in the position illustrated in FIG. 1 so that the hooks 86 can be easily positioned in the eyelet head 74 when the bow is strung as illustrated in FIG. 1. The wire is flexible, yet strong, and made from the same materials as the bowstring 22.

A brace 88 has a notch 90 and a lip 92 at one end thereof. A hole 94 and a hole 96 are provided at opposite ends of the brace. An arched end structure 88 is provided at the end opposite to the notch 90. As illustrated in FIG. 4, the stringer wire 82 can be conveniently doubled and strung through the holes 96 and 94 and wrapped around the lip 92 of the brace when the brace and stringer wires are not being used. Conveniently, the loops 84 can be used to secure the brace and stringer wire to the belt or pack of the archer.

The operation of the stringer wire will now be described with reference to FIGS. 1 and 5 through 7. Normally, the bow is used in the condition illustrated in FIG. 1. The guard members 60 and the stop elements 76 do not interfere with the normal use of the bow. As the bowstring 58 is drawn backwardly, the flexible, resilient limbs 22 will flex in conventional fashion to put an increasing amount of tension on the bow 58. When the bow is not in use, such as when it is being transported in a vehicle, it is necessary to remove the stringer wire. Due to the highly leveraged force on the string wire in the compound bows, it is very difficult if not practically impossible to ordinarily remove the bowstring 58. According to the invention, the stringer wire 80 is secured to the ends of the bow. To this end, the hooks 86 are positioned within the eyelet head 84. The stringer wire 80 is thus sized so that the hooks 86 can easily and conveniently be positioned within the eyelet heads 74 without having to tension the bow any further. The first step is unstringing the bow is thus illustrated in FIG. 5 wherein the stringer wire is shown positioned between the eyelet heads 74.

The notch 90 of brace 88 is then positioned against a central portion of the stringer wire 80 and the wire 80 is then pulled away from the handle 14 until such time as the arched end structure 98 can be placed against the handle 14 as illustrated in FIG. 6. This procedure may be rather difficult but can be carried out by bracing the handle 14 against the foot while pulling the stringer wire 80 with the hand. When the brace 88 is positioned as illustrated in FIG. 6 with the stringer wire 80 drawn back, the flexible resilient arms 22 will be bent as illustrated in FIG. 5 so that the bowstring 58 will be relatively slack. The bowstring then can be removed from the hooks 54 quite easily.

Subsequent to removing the bowstring 58, the brace is removed by a reverse procedure for drawing the stringer wire 80 backwardly. As the tension in the stringer wire 80 is released, the flexible limbs 22 will return to their normal position as illustrated in FIG. 7. However, at this point, the stop elements 76 abut the legs 66 and 68 of the guard member 60. In this manner, the tension in the bow flexible arms 22 and the anchor wire 82 is retained while retaining the ends of the anchor cables 52 in the position illustrated in FIG. 7. When the bow is in this condition, the stringer wire 80 can then be removed from engagement with the eyelet heads 74 so that the bow is thus completely unstrung.

The stringing of the bow takes place quickly and easily in a manner reverse to that procedure described above. Namely, the stringer wire 80 is attached to the eyelet heads 74 and drawn away from the handle 14 until the brace 88 can be positioned between the stringer wire 80 and the handle 14. The bowstring 58 is thereafter hooked to the hooks 54 whereupon the brace 88 and the stringer 80 can be removed.

Thus, the invention provides a device for quickly and easily stringing and unstringing a compound bow. The device is useful with any type of compound bow by providing a means for attaching a stringer wire to the ends of the bow and a means for maintaining the tension in the anchor cable after removal of the bowstring. Depending on the different configurations of compound bows, these elements of the invention may take different forms.

The invention has been described with reference to the compound bow having stringing device incorporated therein. Whereas this is the preferred manner in which the invention is used, it is contemplated that the bows most conveniently would be manufactured with the bow stringing and unstringing device incorporated therein. To this end, various components might be modified from the form shown in the drawings. For example, a conventional notch can be provided at each end of the bow for retaining the stringer wire in lieu of the eyelet-bolt construction. Other modifications will be suggested to those skilled in the art.

Whereas it is preferred and most convenient to manufacture the bows with the stringing and unstringing device of the invention incorporated therein, it is contemplated that a modification kit within the scope of the invention can be provided for retrofitting a conventional compound bow. For example, the guard members 60, the eyelet-bolts 48 having eyelets 78, the stop elements 66, the stringer wire 80 and brace 88 can be sold as a kit for retrofitting the compound bows without such stringing and unstringing devices.

Reasonable variation and modification are possible within the scope of the foregoing disclosure, the drawings and the appended claims without departing from the spirit of the invention.

The embodiments of the invention in which an exclusive property or privilege is claimed are defined as follows:

1. In a compound shooting bow having a handle portion with a pair of resilient limbs extending outwardly thereof, a pulley mounted at the outer end of each resilient limb, a bowstring, anchor wire means including a pair of outer ends, one of which is trained around each pulley to tension the resilient limbs, and means removably securing the bowstring to the outer ends of the anchor wire means, the improvement which comprises:

means on the outer ends of the limbs and on the outer ends of the anchor wire means to prevent movement of the outer ends of the anchor wire means back around the pulleys and to thereby maintain tension on the anchor wire means when the bowstring is removed from the anchor wire means;

whereby the bowstring can be removed from the anchor wire means loss of tension in the anchor wire means and in the resilient limbs.

2. A compound shooting bow according to claim 1 and further comprising means for mounting a stringer wire on the outer ends of the resilient limbs, whereby the tension on the bowstring can be relieved for ease of removal thereof by securing a stringer wire to the stringer wire mounting means and tensioning the stringer wire.

3. A compound shooting bow according to claim 2 and further comprising a stringer wire having a length approximately equal to the distance between the stringer wire mounting means on the resilient limbs.

4. A compound shooting bow according to claim 3 and further comprising a brace sized to fit between the handle portion and a central portion of the stringer wire when the stringer wire has been drawn away from the handle portion sufficiently to relieve the tension in the bowstring, the brace comprising seating means at one end of the brace for retaining the brace on the handle portion and means at another end of the brace for retaining the stringer wire under tension.

5. A compound shooting bow according to claim 4 wherein the brace further comprises means for releasably retaining the stringer wire when the same is not in use.

6. A compound shooting bow according to claim 5 wherein the stringer wire retaining means includes a lip on one end thereof and at least one hole at an opposite end thereof whereby the stringer wire may be looped around the lip and drawn through the hole.

7. A compound shooting bow according to claim 6 wherein the stringer wire further comprises a loop at at least one end thereof for carrying the stringer wire and the brace from a belt or hook when the stringer wire and brace are not in use.

8. A compound shooting bow according to claim 7 wherein the movement preventing means for the anchor wire means includes guard means secured to each of the resilient limbs adjacent the ends of the anchor wire means, and stop means retainably mounted at end portions of the anchor wire such that the stop means abut the guard means and retain the end portions of the anchor wire means when the bowstring is removed from the ends of the anchor wire means.

9. A compound shooting bow according to claim 8 wherein the guard means comprise a curved bifurcated clip of a stiff material, an upper part of which clip is secured to the outer end of one of the resilient limbs and a lower bifurcated part of the clip forms a slot through which passes one of the needs of the anchor wire means, the bifurcated end of the clip being positioned between one of the pulleys and the stop means on one of the anchor wire means.

10. A compound shooting bow according to claim 9 wherein the stringer wire mounting means includes an eyelet-bolt mounted to each outer end of the resilient limbs and means on the eyelet-bolt to secure the upper part of the curved clip to the respective end of the resilient limb.

11. A compound shooting bow according to claim 2 wherein the movement-preventing means for the anchor wire means includes guard means secured to each end of the resilient limbs adjacent the outer ends of the anchor wire means and stop means retainably mounted at end portions of the anchor wire means such that the stop means abut the guard means and retain the end portions of the anchor wire means when the bowstring is removed from the ends of the anchor wire.

12. A compound shooting bow according to claim 11 wherein the guard means comprise a curved bifurcated clip of stiff material, an upper part of which clip is secured to the outer end of one of the resilient limbs and the lower bifurcated part of which clip forms a slot through which passes one of the ends of the anchor wire means, the bifurcated end of the curved clip being positioned between one of the pulleys and the stop means on one of the anchor means.

13. A compound shooting bow according to claim 12 wherein the stringer wire mounting means includes an eyelet-bolt mounted to each outer end of the resilient limb and means on the eyelet-bolt to secure the upper part of the curved clip to the respective end of the resilient limb.

14. A compound shooting bow according to claim 2 wherein the stringer wire mounting means includes an eyelet-bolt mounted to each outer end of the resilient limbs.

15. A compound shooting bow according to claim 1 and further comprising a stringer wire having a length approximately the distance between the ends of the resilient limbs.

16. A compound shooting bow according to claim 15 and further comprising a brace sized to fit between the handle portion and a central portion of the stringer wire when the stringer wire has been pulled away from the handle portion to relieve the tension of the bowstring, the brace comprising seating means at one end thereof for retaining the brace on the handle portion and means at the other end thereof for retaining the stringer wire under tension.

17. A compound shooting bow according to claim 1 wherein the movement preventing means for the anchor wire means includes guard means secured to the outer ends of each resilient limb adjacent the ends of the anchor wire means, and stop means retainably mounted at the end portions of the anchor wire means such that the stop means abuts the guard means and retains the end portions of the anchor wire means when the bowstring is removed from the ends of the anchor wire means.

18. A compound shooting bow according to claim 17 wherein the guard means comprises a curved bifurcated clip of stiff material, the upper part of which is secured to the outer end of one of the resilient limbs and a lower part of which bifurcated clip forms a slot through which passes one of the ends of the anchor wire means, the bifurcated end of the clip being positioned between one of the pulleys and the stop means on the one end of the anchor wire means.

19. A bow stringing and unstringing device for a compound shooting bow having a handle portion with a pair of resilient limbs extending outwardly thereof, a pulley mounted at the outer end of each resilient limb, a bowstring, anchor wire means including a pair of outer ends, one of which is trained around each pulley to tension the resilient limbs, and means removably securing the bowstring to the outer ends of the anchor wire means, the bow stringing and upstringing device comprising:

means for mounting on outer ends of resilient bow limbs and on ends of bow anchor wire means to prevent movement of the ends of the anchor wire means back around bow pulleys abut which the anchor wire is trained and thereby to maintain tension on the anchor wire means when a bowstring is removed from the anchor wire means, whereby the bowstring can be removed from the anchor wire means while maintaining tension in the resilient limbs and anchor wire means.

20. A bow stringing and unstringing device according to claim 19 and further comprising means for mounting a stringer wire on the outer ends of the resilient limbs, whereby the tension on the bowstring can be released for ease of removal thereof by securing a stringer wire to the outer ends of the resilient limbs and tensioning the stringer wire.

21. A bow stringing and unstringing device according to claim 20 and further comprising a stringer wire having a length approximately equal to the distance between the outer ends of the resilient limbs when the bowstring is attached to the ends of the anchor wire means.

22. A bow stringing and unstringing device according to claim 21 and further comprising a brace sized to fit between a bow handle portion and a central portion of the stringer wire when the stringer wire has been drawn away from the handle portion of the bow to relieve the tension of the bowstring, the brace comprising seating means at one end thereof for retaining the brace on the handle portion and means on the other end thereof for retaining the stringer wire under tension.

23. A bow stringing and unstringing device according to claim 22 wherein the brace further comprises means for releasably retaining the stringer wire when the same is not in use.

* * * * *

UNITED STATES PATENT AND TRADEMARK OFFICE

CERTIFICATE OF CORRECTION

PATENT NO. : 4,077,385

DATED : March 7, 1978

INVENTOR(S) : Bert E. Fredrickson

It is certified that error appears in the above-identified patent and that said Letters Patent are hereby corrected as shown below:

Column 2, line 26, after "means" insert --when--.

Column 2, line 29, after "guard" insert --means--.

Column 3, line 20, after "cable" insert --52--.

Column 4, line 45, delete "is" and substitute therefor --in--.

Column 5, line 13, after "stringer" insert --wire--.

Column 5, line 25, after "having" insert --the bow--.

Column 6, line 2, after "means" insert --without--.

Column 6, line 52, delete "needs" and substitute --ends--.

Column 8, line 17, delete "abut" and insert --about--.

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*